US008100469B2

(12) United States Patent
Lougee

(10) Patent No.: US 8,100,469 B2
(45) Date of Patent: Jan. 24, 2012

(54) COLLAPSIBLE CHAIR WITH CURVED BACK SUPPORT

(75) Inventor: Laurence Lougee, San Francisco, CA (US)

(73) Assignee: Strongback, LLC, Worcester, MA (US)

( * ) Notice: Subject to any disclaimer, the term of this patent is extended or adjusted under 35 U.S.C. 154(b) by 288 days.

(21) Appl. No.: 12/459,961

(22) Filed: Jul. 9, 2009

(65) Prior Publication Data

US 2011/0006564 A1 Jan. 13, 2011

(51) Int. Cl.
*A47C 7/46* (2006.01)

(52) U.S. Cl. ..... 297/58; 297/452.3

(58) Field of Classification Search ..... 297/16.1, 297/16.2, 55, 58, 284.4, 452.3, 452.31
See application file for complete search history.

(56) References Cited

U.S. PATENT DOCUMENTS

| | | | | |
|---|---|---|---|---|
| 820,864 | A * | 5/1906 | Hanger | 297/317 |
| 3,711,156 | A | 1/1973 | Bloomfield | |
| 4,118,065 | A * | 10/1978 | Watkins | 297/45 |
| 5,058,949 | A | 10/1991 | Von Hoffman | |
| 5,882,068 | A | 3/1999 | Levine | |
| 6,186,594 | B1 * | 2/2001 | Valiquette et al. | 297/284.4 |
| 6,322,147 | B1 * | 11/2001 | Leib | 297/452.19 |
| 6,634,705 | B1 * | 10/2003 | Zheng | 297/41 |
| 6,682,135 | B2 | 1/2004 | Zheng | |
| 6,736,450 | B2 | 5/2004 | Miyagi | |
| 6,752,452 | B2 | 6/2004 | Choi et al. | |
| 6,755,462 | B2 | 6/2004 | Zheng | |
| 6,814,408 | B2 * | 11/2004 | Chen | 297/284.6 |
| 6,899,383 | B2 * | 5/2005 | Hwang | 297/16.2 |
| 7,717,502 | B2 * | 5/2010 | Deng | 297/23 |
| 2003/0025361 | A1 | 2/2003 | Liu | |
| 2005/0275264 | A1 * | 12/2005 | Norman et al. | 297/284.4 |

FOREIGN PATENT DOCUMENTS

EP 0 786 219 A1 7/1997

OTHER PUBLICATIONS

International Search Report issued in corresponding PCT Application No. PCT/US2010/041514; International Filing Date, Jul. 9, 2010.

* cited by examiner

*Primary Examiner* — Peter R. Brown
(74) *Attorney, Agent, or Firm* — Brian M. Dingman; Mirick, O'Connell, DeMallie & Lougee, LLP

(57) ABSTRACT

This invention is a backrest for collapsible or foldable chairs that provides ample and comfortable back support for a seated person. The backrest consists of a Collapsible Back Support Curve that, when incorporated properly into a collapsible chair, is easy to set-up, collapse, store and transport, and it is visually appealing and durable. The invention is incorporated into collapsible chairs by shaping the chair back-rest support members in parallel gradual curves that force a membrane taught between them, evenly along their length, when in an open (non-collapsed) position. The invention, although a stationary part of a chair without complicated moveable parts, is designed to fit people of different heights and different back-arch preferences.

8 Claims, 7 Drawing Sheets

COLLAPSIBLE CHAIR WITH CURVED BACK SUPPORT

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to collapsible or folding chairs. More particularly, the invention concerns a novel folding chair having a uniquely configured curved back support that provides superior back support for a person seated upon the chair.

2. Description of Related Art Including Information Disclosed Under 37 CFR 1.97 and 1.98

Collapsible chairs are well known around the world as convenient options for seating at locations where seating is otherwise unavailable. They are easily stored, transported and set up for a variety of indoor and outdoor uses including camping, fishing, painting, sporting events, or concerts and parties. The time spent in these chairs is often over several hours. However, most of the collapsible chairs in use today do not have enough back support necessary for a healthy spine when used for sitting for these lengthy periods of time.

According to the American Chiropractic Association, one-half of all working Americans admit to having back pain symptoms each year and experts estimate that as many as 80% of the population will experience a back problem at some time in their lives. The importance of back-support in office chairs, where people sit for hours at a time, is well known to users and manufacturers. Entire fields of study within ergonomics and medicine have resulted from the magnitude of the need for proper posture when seated. However, a negligible amount of attention has been given to the importance of back support in folding chairs despite their widespread use.

A popular type of collapsible chair is the "sling" or "quad" chair where the chair membrane is supported at four points, two on the top of the chair back-rest and two on the end of the chair seat, creating a "sling" or hammock-like look and feel where the membrane sags in-between the four points of support. The problem with this configuration is there is no support for the back. And, unlike lying horizontally in a hammock, a seated person's back is closer to vertical which transfers their weight directly onto their spine. When seated in these types of chairs, a person's lower back bends to conform to the sagging curve of the membrane material, a direction that is the reverse of the natural curve of the lower back, thus placing tremendous stress on the intervertebral disks of the spine. This stress results in an often uncomfortable, sometimes painful, and always unhealthy, round curve of the lower back that can have long lasting effects on a person's quality of life.

Other collapsible chairs differ from the "sling" type chairs by having the chair membrane attached at more than four points. For example, some chairs have the membrane attached continuously along straight back support members. However, these chairs are only marginally better than the "sling" type configuration for back support. When a person sits in these chairs, their weight stretches the membrane, causing the same problem as found in the sling chairs; the lower back bends in the reverse direction from its natural curve to conform to the curve of the membrane material, thus placing unnatural stress on their spine. Even if the membrane could remain perfectly straight under a person's weight, these chairs would be inadequate because they would not match the natural curve of the human spine. That is, even straight chair-backs allow the spine to bend out of the natural, healthy, reverse-curved position.

Because people are different sizes and have different amounts of curve to their spine it stands to reason that any back support system needs to fit the needs of the individual. Some attempts have been made to make adjustable back support mechanisms in collapsible chairs, such as in U.S. Pat. No. 5,882,068 (E. R. Levine, 1999) but adjustable supports like these have disadvantages because they add manufacturing expenses, materials, weight, and tend to break more easily than chairs without moving parts. For chairs that are often used in harsh field conditions, these features are key considerations of distributors and buyers. Other collapsible chairs with adjustable back support, such as the Ergopod, have additional disadvantages in that they are visually unappealing due to strange "contraption-like" appearances.

It is therefore necessary to develop a collapsible chair that provides adequate back support that includes all of the advantages of existing collapsible chairs with no disadvantages due to the inclusion of a back support mechanism. As such, this chair should be easily set-up, collapsible, storable and transportable. It should also be visually appealing, durable, and fit the needs of a wide range of people.

BRIEF SUMMARY OF THE INVENTION

By way of brief summary, the folding chair of the present invention comprises a frame including a seat portion, a front leg portion pivotally connected to the seat portion, a rear leg portion pivotally connected to the seat portion and a back portion connected to the seat portion. The back support portion of the folding chair uniquely comprises a pair of transversely spaced apart, forwardly extending convex members that are so constructed and arranged to match the curve of the lumbar region of the spine of a person seated on the folding chair. A flexible membrane covers the seat portion and the pair of transversely spaced apart, forwardly extending convex members to define a back support region that closely matches the curve of the lumbar region of the spine of a person seated on the folding chair.

With the forgoing in mind, it is an object of the present invention to provide a foldable chair having a uniquely configured curved back support that provides superior back support for a person seated upon the chair.

Another object of the invention is to provide a foldable chair of the character described in which the back portion of the chair is uniquely designed to provide a curved back support region that closely matches the curve of the lumbar region of the spine of a person seated on the folding chair.

Another object of the invention is to provide a foldable chair of the aforementioned character that is visually appealing, durable, and provides healthy back support that fits the needs of a wide range of people. More particularly, the foldable chair of the invention is uniquely designed to fit people of different heights and different back-arch preferences.

Another object of the invention is to provide a foldable chair as described in the preceding paragraphs that is easy to set-up, collapse, store, and transport.

The forgoing as well as other objects of the invention will be achieved by the novel foldable chair illustrated in the attached drawings and described in the specification that follows.

DETAILED DESCRIPTION OF THE INVENTION

Figure 1:
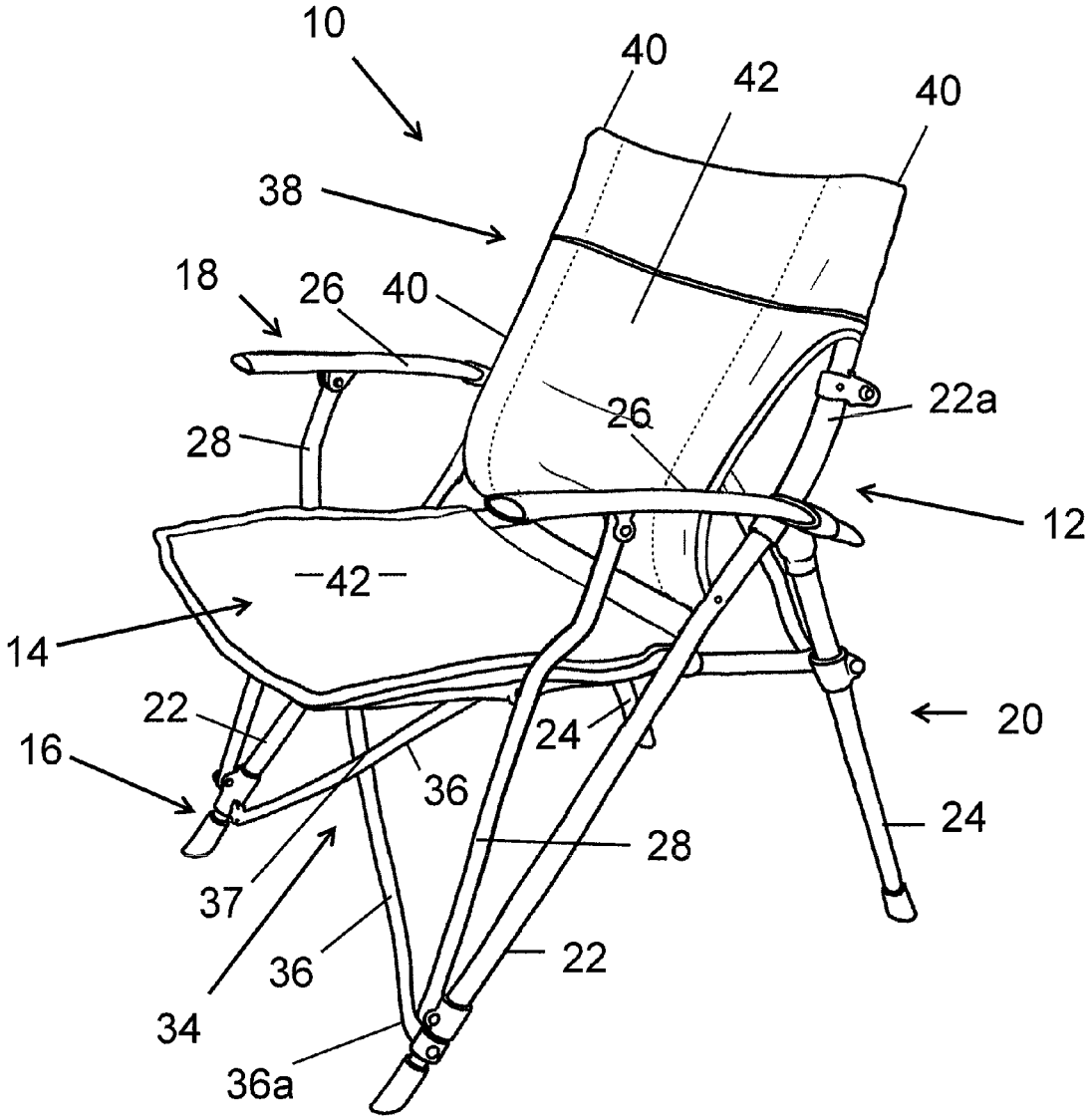
FIG. 1 is a generally perspective front view of one form of the folding chair of the present invention.
Figure 2:
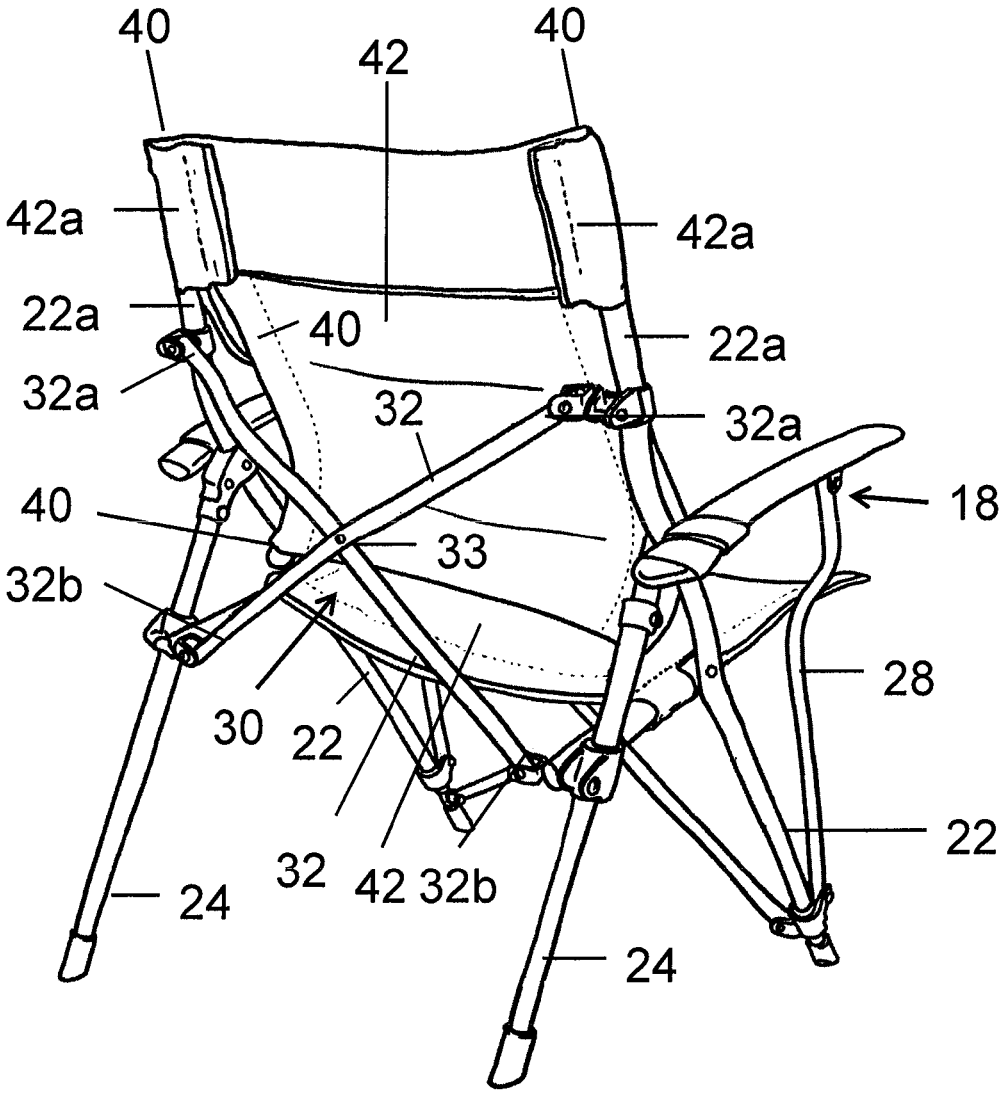
FIG. 2 is a generally perspective rear view of the folding chair shown in FIG. 1.
Figure 3:
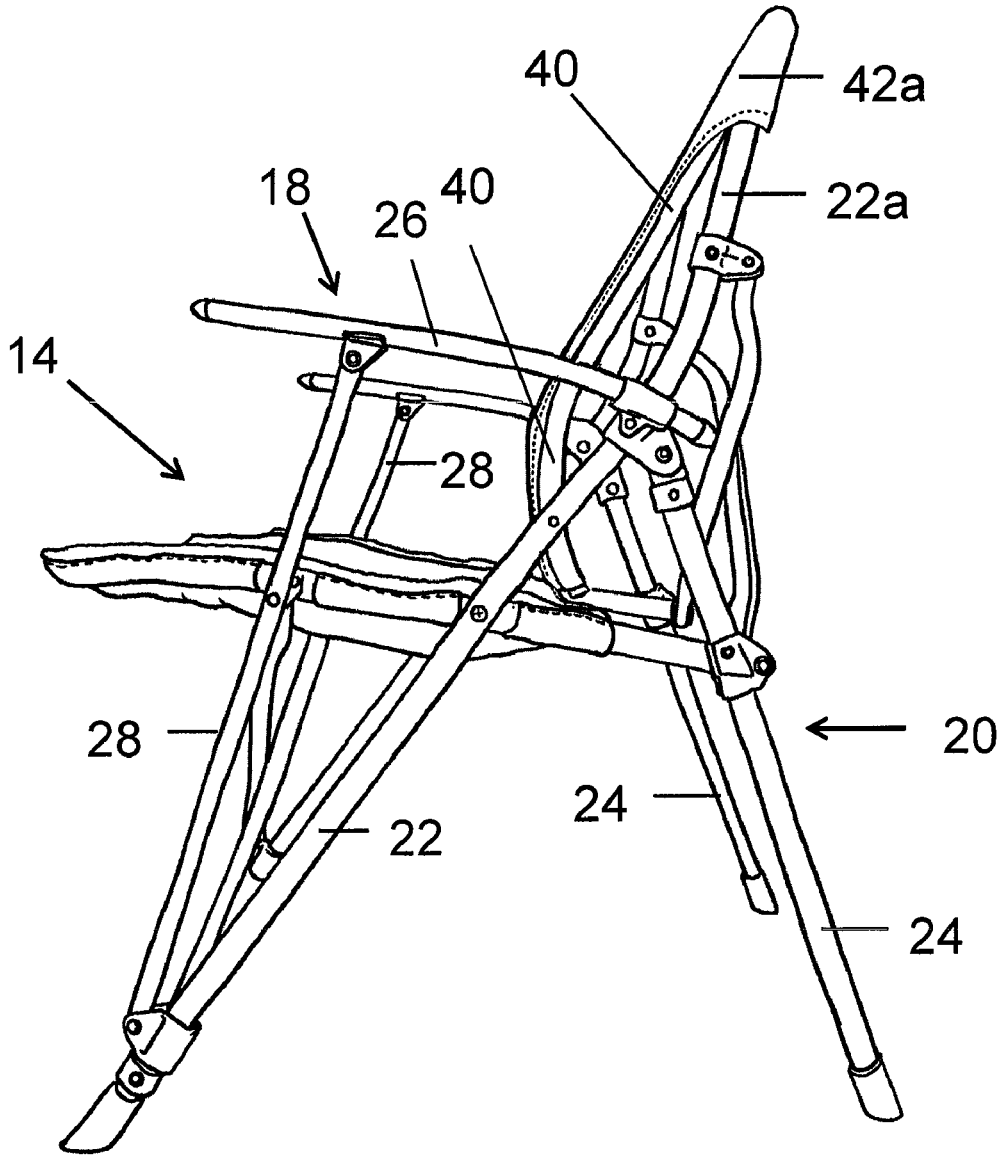
FIG. 3 is a side elevational view of the folding chair shown in FIG. 1.

Referring to the drawings and particularly to FIGS. 1 through 3 of the drawings, one form of the folding chair of the present invention is there illustrated and generally designated by the numeral 10. In this form of the invention, the folding chair 10 comprises a frame 12 that includes a seat portion 14, a front leg portion 16 pivotally connected to seat portion 14, an arm support assembly 18 pivotally connected to front leg portion 16 and a rear leg portion 20 also pivotally connected to the seat portion.

As best seen in FIGS. 1 and 2 of the drawings, the front leg portion 16 comprises a pair of transversely spaced apart front legs 22 and the rear leg portion 20 comprises a pair of transversely spaced apart rear legs 24. Similarly, arm support assembly 18 comprises a pair of transversely spaced apart arms 26 and a pair of transversely spaced apart arm supports 28 that are connected to the arms 26 and to the front leg portion 16. To provide support to the rear portion of the chair frame 12, a rear support assembly 30 is provided. As best seen in FIG. 2 of the drawings, rear support assembly 30 comprises a pair of pivotally interconnected, crossing support members 32. The upper extremities 32*a* of the support members are pivotally connected to an upper extension 22*a* of front leg portion 16. Similarly, the lower extremities 32*b* of the support members are pivotally connected to rear legs 24. Support members 32 pivot relative to each other about a central pivot point 33 (FIG. 2). To provide support to the front leg portion of the chair frame 12, a front support assembly 34 is provided. As best seen in FIG. 1 of the drawings, front support assembly 34 comprises a pair of pivotally interconnected, crossing support members 36. The upper extremities of the support members are pivotally connected to the seat portion of the frame, while the lower extremities 36*a* are pivotally connected to front legs 22. Support members 36 pivot relative to each other about a central pivot point 37 (FIG. 1).

Forming an important aspect of the folding chair of the present invention is a back portion 38 that is connected to and extends upwardly from the seat portion 14. In the present form of the invention, the important back support portion comprises the previously mentioned upward extension 22*a* of front leg portion 16 and a pair of transversely spaced apart, forwardly extending, strategically shaped, convex members 40 that are connected proximate their upper end to upward extension 22*a* of the front leg portion 16 (see FIG. 3). As will be discussed in greater detail hereinafter, convex members 40 are uniquely constructed and arranged to match the curve of the lumbar region of the spine of a person seated on the folding chair.

Figure 5:
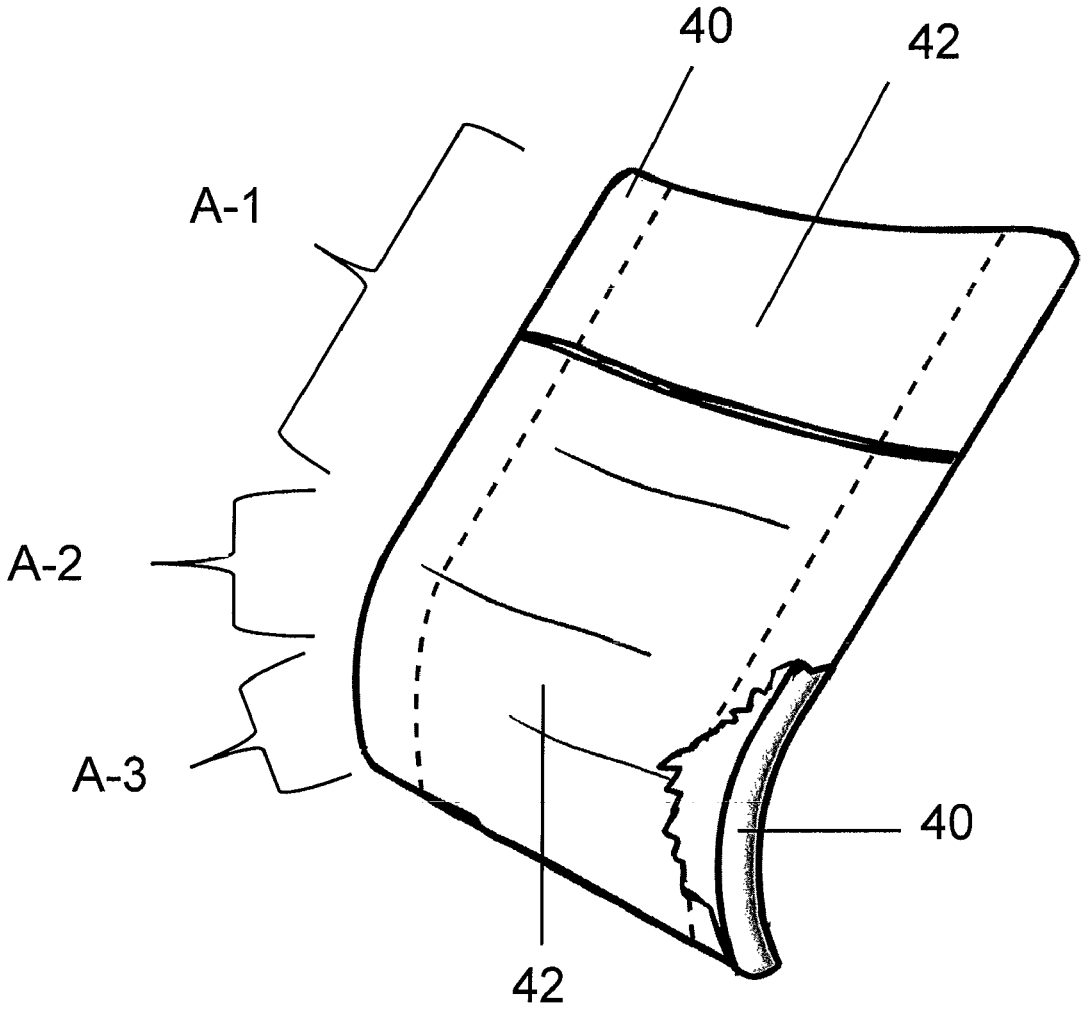
FIG. 5 is a generally perspective, fragmentary front view of the backrest portion of the folding chair shown in FIG. 1.
Figure 6:
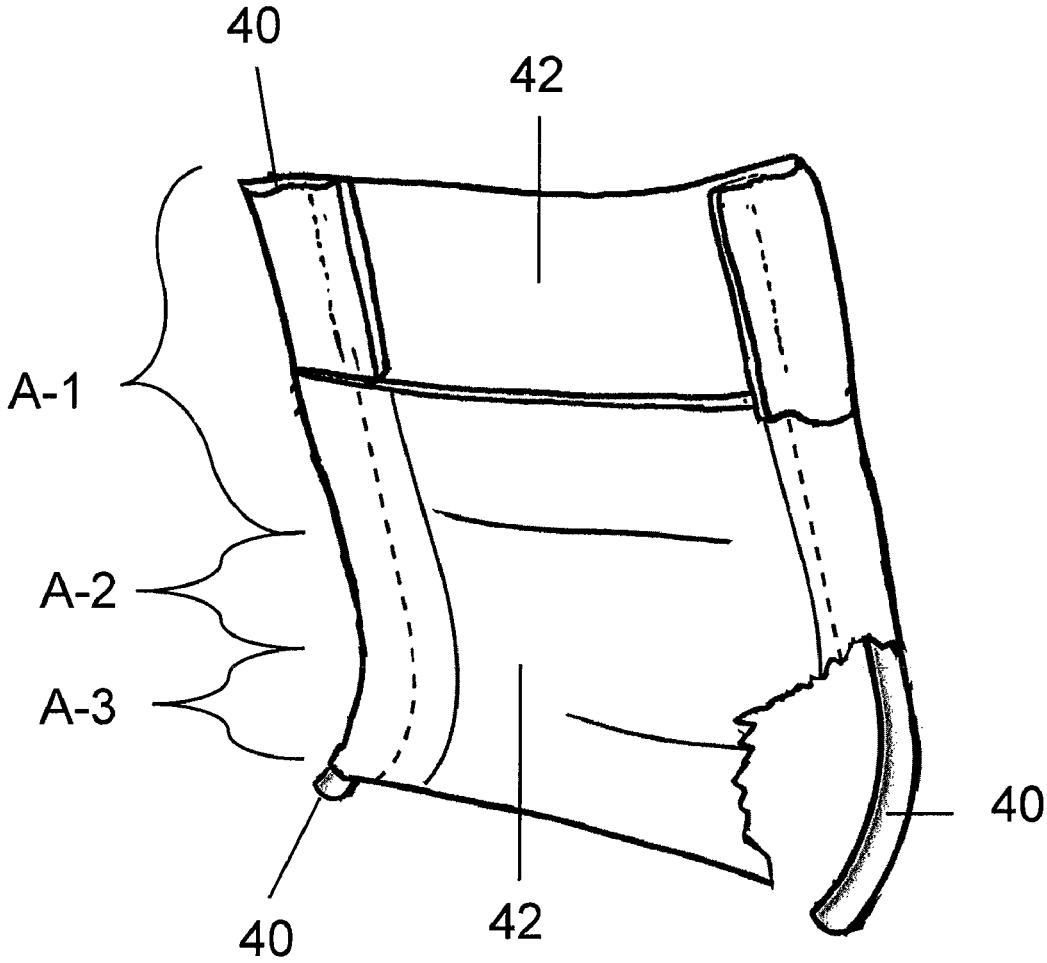
FIG. 6 is a generally perspective, fragmentary rear view of the backrest portion of the folding chair shown in FIG. 1.
Figure 7:
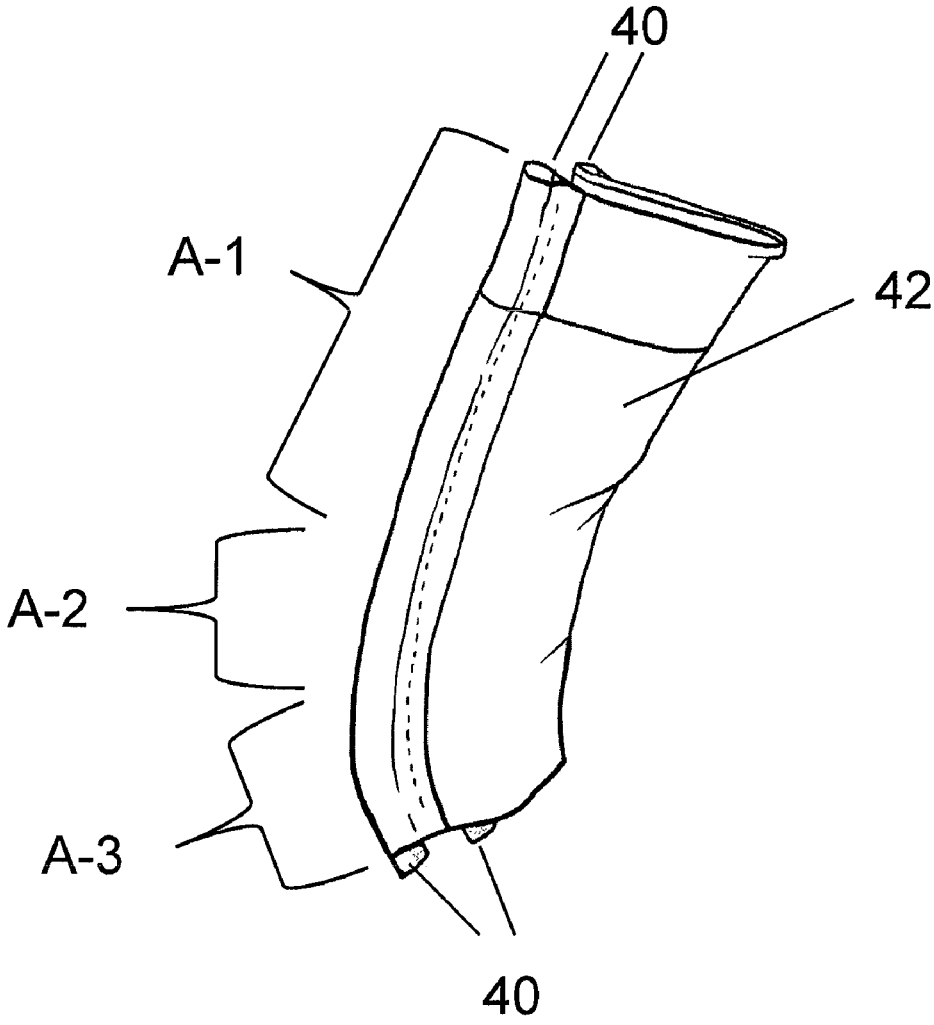
FIG. 7 is a fragmentary side view of the backrest portion of the folding chair shown in FIG. 6.

As best seen in FIG. 1 of the drawings, a covering, shown here as a flexible membrane 42, covers seat portion 14 as well as the upper back portion of the chair frame and the transversely spaced apart, forwardly extending convex members 40. In order to snugly fit over and be secured to the upper extremities of the chair frame, the upper corner margins 42*a* of the membrane can be folded over and sewn in the manner depicted in FIG. 2. Membrane 42 can be constructed from various flexible sheet materials such as heavy cloth, canvas, plastic and like durable materials. When in position over the chair frame in the manner illustrated in the drawings, the flexible membrane is uniquely constructed and arranged to provide support through the lumbar region and into the thoracic region of a person seated in the chair. More particularly, as show in FIGS. 5-7, when the membrane 42 is in position over members 40 it will be strategically shaped to form a gentle arc (designated in the drawings as A-2 and A-3) that matches the curve of the lumbar region of the human spine (lower back). The location and arc is such that when a person is seated on the chair, it begins at the lowest lumbar area A-3 of the spine and straightens out in the thoracic area A-1 (mid-region of a person's back). As previously mentioned, the arc formed by the back portion is convex and is the reverse of the sagging concave curve found in many prior art "sling" type chairs, thus conforming to the natural direction of the curve in a seated person's lower back, and providing support throughout the lumbar region and into the thoracic region.

As indicated in FIGS. 1 and 2 of the drawings, when a collapsible chair is in the open seating position, the membrane 42 is stretched tightly between members 40 thus creating a back-rest surface area that is curved in proportion with the curve of the members 40. When the chair is in use the membrane 42 is stretched taught by the weight of the person in the seat portion 14 of the chair. More particularly, the weight of a seated person forces the back-rest support members 40 to be pushed apart until the movement is stopped by the tension of the membrane connecting them. Advantageously, the tension on the membrane 42 that is caused by the weight of a seated person is distributed evenly along the length of the entire arc A-1 through A-3, thus creating a uniform area of taught support. The even and taught support of the membrane 42 formed into the gentle arc A-1 through A-3 uniquely matches the natural curve of the human spine, and allows for positive back support of the seated person that is distributed evenly, firmly, and comfortably along the person's back.

Another unique feature of the foldable chair of the present invention resides in the fact that the chair adapts to fit people of different heights due to the fact that the membrane 42 has some give (is not completely rigid as found in a solid material like wood or metal) and further that the arc of the A-2 and A-3 is gently rounded or gradual (not sharp or abrupt). The membrane 42, although taught, exhibits enough give to conform to the seated person's back when leaned against, but not so much give as to lose the reverse curve shape as previously discussed. The arc A-2 through A-3, instead of being a sharp band providing merely a few vertical inches of support along a person's spine, matches the gentle curve in an average person's spine and provides support along the majority of a person's lower back. These novel features combine such that when people of different heights sit on the chair, the membrane 42 only needs to give (move) a small amount to conform to a large diversity of people, both shorter and taller than average, to provide a continuous area of back support.

The arc formed by the seat back portion also advantageously fits people with different preferences for the amount of arch in their back (e.g. some people like to sit in a chair that supports a large arch to their back). More particularly, in order to adjust the amount of arc, the individual simply has to adjust the seating position in relation to the arc in order to alter the amount of arch in the back. Stated another way, the arc of the back portion of the chair is uniquely designed so that a person seated on the chair can move their position in the seat and rest their back upon a greater arc, causing a greater arching of their back, or a shorter arc, thereby minimizing arching of their back. As indicated in the drawings, the arc defined by the members 40 is located high enough off of the seat portion of a chair and is strategically curved so as to allow a seated person to slide their buttocks from a position that is not under the lower arc A-3, to a position that is well under the lower arc A-3, while keeping the remainder of their back firmly against the back portion. For example, if a seated person keeps their mid-back firmly against the back portion and slides their buttocks to the rear of the chair, further under the lower arc A-3, their back will rest against a larger portion of the arc A-2 and A-3 causing a correspondingly larger amount of arch to their back.

Figure 4:
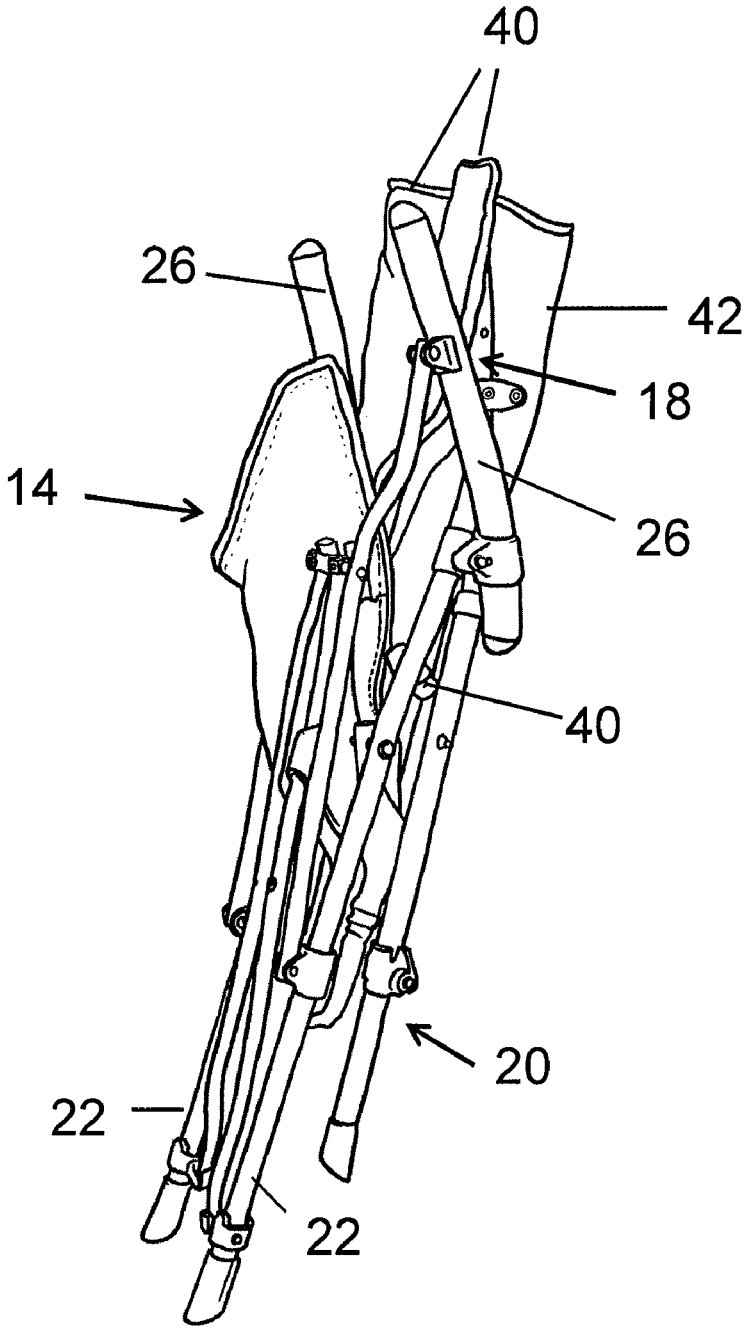
FIG. 4 is a side elevational view of the folding chair shown in FIG. 1 as it appears in the folded configuration.

In use, the folding chair of the present invention can be readily folded into the configuration shown in FIGS. 1, 2 and 3 of the drawings. When it is desired to store, or transport the folding chair, the chair can be readily collapsed into the folded configuration shown in FIG. 4 of the drawings. As indicated in FIG. 4, the chair in its folded configuration is quite compact and easily transportable.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

The invention claimed is:

1. A folding chair comprising:

(a) a frame including:

(i) a seat portion;

(ii) a front leg portion pivotally connected to said seat portion, said front leg portion comprising a pair of transversely spaced apart front legs;

(iii) a rear leg portion pivotally connected to said seat portion, said rear leg portion comprising a pair of transversely spaced apart rear legs; and (iv) a back portion connected to said seat portion, said back portion comprising a pair of transversely spaced apart upward extension members each having a first upper end and a second, distal lower end, and a pair of transversely spaced apart, forwardly extending convex members each having a first upper end and a second, distal lower end;

where each upward extension member is connected at its lower end to one of the front legs;

where each convex member is connected proximate at its upper end to the upper end of one of the upward extension members and each convex member is further connected proximate its lower end to one of the front legs; and where the back portion is constructed and arranged as to match the curve of the lumbar region of the spine of a person seated on the folding chair; and (b) a flexible membrane covering said seat portion and said pair of transversely spaced apart, forwardly extending convex members, said flexible membrane connected to and spanning said spaced apart front legs.

2. The folding chair as defined in claim 1 in which said frame further includes an arm support assembly pivotally connected to said front leg portion.

3. The folding chair as defined in claim 2 in which said arm support assembly comprises a pair of transversely spaced apart arms and a pair of transversely spaced apart arm supports connected to said arms and said front leg portion.

4. The folding chair as defined in claim 1 further including a rear support assembly connected to said rear leg portion and to said back portion, said rear support assembly comprising pair of pivotally interconnected, crossing support members.

5. The folding chair as defined in claim 1 in which when in position covering said pair of transversely spaced apart, forwardly extending convex members, said flexible membrane is so constructed and arranged as to conform to the natural direction of the curve of a seated person's lower back, and to function in a manner to provide support throughout the lumbar region and into the thoracic region of the seated person.

6. A folding chair comprising:

(a) a frame including:

(i) a seat portion;

(ii) a front leg portion pivotally connected to said seat portion, said front leg portion comprising a pair of transversely spaced apart front legs;

(iii) a rear leg portion pivotally connected to said seat portion, said rear leg portion comprising a pair of transversely spaced apart rear legs;

(iv) an arm support assembly pivotally connected to said front leg portion, said arm support assembly comprising a pair of transversely spaced apart arms and a pair of transversely spaced apart arm supports connected to said arms and said front leg portion; and (v) a front support assembly connected to said front leg portion and to said seat portion, said front support portion comprising a pair of pivotally interconnected, crossing support members;

(vi) a back portion connected to said seat portion, said back portion comprising a pair of transversely spaced apart upward extension members each having a first upper end and a second distal lower end, and a pair of transversely spaced apart, forwardly extending convex members each having a first upper end and a second distal lower end, where each upward extension member is connected at its lower end to one of the front legs;

where each convex member is connected proximate its upper end to the upper end of one of the upward extension members and each convex member is further connected proximate its lower end to one of the front legs; and where the back portion is constructed and arranged as to match the curve of the lumbar region of the spine of a person seated on the folding chair; and, (b) a flexible membrane covering said seat portion and said pair of transversely spaced apart, forwardly extending convex members, said flexible membrane connected to and spanning said spaced apart front legs, said flexible membrane being so constructed and arranged as to provide support throughout the lumbar region and into the thoracic region of a person seated in the chair.

7. The folding chair as defined in claim 6 further including a rear support assembly connected to said rear leg portion and to said back portion, said rear support assembly comprising pair of pivotally interconnected, crossing support members.

8. The folding chair as defined in claim 6 in which when in position covering said pair of transversely spaced apart, forwardly extending convex members, said flexible membrane is so constructed and arranged as to conform to the natural direction of the curve of a seated person's lower back, and to function in a manner to provide support throughout the lumbar region and into the thoracic region of the seated person.

* * * * *